US012007184B2

(12) United States Patent
Mathew et al.

(10) Patent No.: US 12,007,184 B2
(45) Date of Patent: Jun. 11, 2024

(54) ANGLED BAFFLES FOR A HEAT EXCHANGER

(71) Applicant: Johnson Controls Tyco IP Holdings LLP, Milwaukee, WI (US)

(72) Inventors: Rakesh Mathew, Wichita, KS (US); Lester Dale Sherrow, Wichita, KS (US); Daniel William Davis, II, Wichita, KS (US); Bennie Dale Hoyt, Benton, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 242 days.

(21) Appl. No.: 17/377,066

(22) Filed: Jul. 15, 2021

(65) Prior Publication Data

US 2023/0014432 A1 Jan. 19, 2023

(51) Int. Cl.

| | |
|---|---|
| ***F24H 9/00*** | (2022.01) |
| ***F28F 9/00*** | (2006.01) |
| *F24H 9/02* | (2006.01) |
| *F24H 9/06* | (2006.01) |

(52) U.S. Cl.

CPC ..... *F28F 9/005* (2013.01); *F24H 9/02* (2013.01); *F24H 9/06* (2013.01); *F28F 2235/00* (2013.01)

(58) Field of Classification Search

CPC ..... F28F 9/005; F28F 2235/00; F24H 9/02; F24H 9/06

See application file for complete search history.

(56) References Cited

U.S. PATENT DOCUMENTS

| | | | | |
|---|---|---|---|---|
| 6,564,794 | B1 | 5/2003 | Zia et al. | |
| 6,564,795 | B1 | 5/2003 | Sears et al. | |
| 6,732,728 | B2 | 5/2004 | Hill et al. | |
| 8,656,905 | B2 | 2/2014 | Noman et al. | |
| 9,297,552 | B2 | 3/2016 | Noman et al. | |
| 9,982,912 | B2 | 5/2018 | Wagers et al. | |
| 10,006,661 | B2 | 6/2018 | Hanks et al. | |
| 10,386,063 | B2 | 8/2019 | Noman et al. | |
| 10,533,772 | B2 | 1/2020 | Lemon et al. | |
| 10,690,378 | B2 * | 6/2020 | Wagers | F24H 3/087 |
| 2013/0075062 | A1 * | 3/2013 | Noman | F24F 13/081 165/96 |
| 2016/0131396 | A1 * | 5/2016 | Hanks | F28F 9/013 126/116 R |
| 2016/0131397 | A1 * | 5/2016 | Wagers | F24H 9/0068 126/99 D |

* cited by examiner

*Primary Examiner* — Gonzalo Laguarda
(74) *Attorney, Agent, or Firm* — Fletcher Yoder, PC

(57) ABSTRACT

A baffle for a furnace of a heating, ventilation, and air conditioning (HVAC) system includes a mounting flange configured to be secured to a housing of the furnace. The baffle also includes a first panel extending from the mounting flange into an air flow path extending through the furnace and a second panel extending from the first panel toward the housing.

20 Claims, 9 Drawing Sheets

ANGLED BAFFLES FOR A HEAT EXCHANGER

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are used in many residential and commercial environments to control the climate of an inhabited space. For example, HVAC systems may be configured to cool, heat, dehumidify, filter, and/or otherwise condition an air flow and supply the air flow to a space in order to condition the space. To this end, many HVAC systems include one or more heat exchangers configured to circulate a working fluid and enable heat transfer between the working fluid and an air flow conditioned by the HVAC system. Heat exchangers may include tubes configured to circulate the working fluid. The HVAC system directs air across the tubes, and heat is exchanged between the air and the working fluid flowing within the tubes, for example, to create a heated or cooled air flow. The conditioned air flow may then be directed to a conditioned space.

In some instances, air may flow across the tubes of the heat exchanger unevenly. For example, certain portions of the tubes may contact less air flow than other portions of the tubes, which may result in uneven temperatures (e.g., hot spots) at different portions of the tubes. Over time, this uneven temperatures may cause degradation of the tubes, reduce performance of the heat exchanger, and/or shorten a useful life of the heat exchanger. Additionally, as air flows across the heat exchanger, eddy currents may form within the HVAC system, such as adjacent to the heat exchanger. The eddy currents increase air flow resistance in the HVAC system, which results in increased power usage to maintain a desired air flow amount.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a baffle for a furnace of a heating, ventilation, and air conditioning (HVAC) system includes a mounting flange configured to be secured to a housing of the furnace. The baffle also includes a first panel extending from the mounting flange into an air flow path extending through the furnace and a second panel extending from the first panel toward the housing.

In another embodiment, a furnace of a heating, ventilation, and air conditioning (HVAC) system includes a housing defining an airflow through the furnace. The furnace also includes a baffle mounted to the housing, which includes a flange secured to the housing, a first panel extending from the flange into the air flow path, and a second panel extending from the first panel toward the housing.

In a further embodiment, a furnace includes a housing including a plurality of panels coupled to one another to define an air flow path extending through the housing. The furnace also includes a heat exchanger disposed within the air flow path of the housing. The furnace also includes a baffle secured to a panel of the plurality of panels. The baffle includes a flange mounted to the panel, a first baffle panel extending from the flange into the air flow path and toward the heat exchanger, and a second baffle panel extending from the first baffle panel toward the panel.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
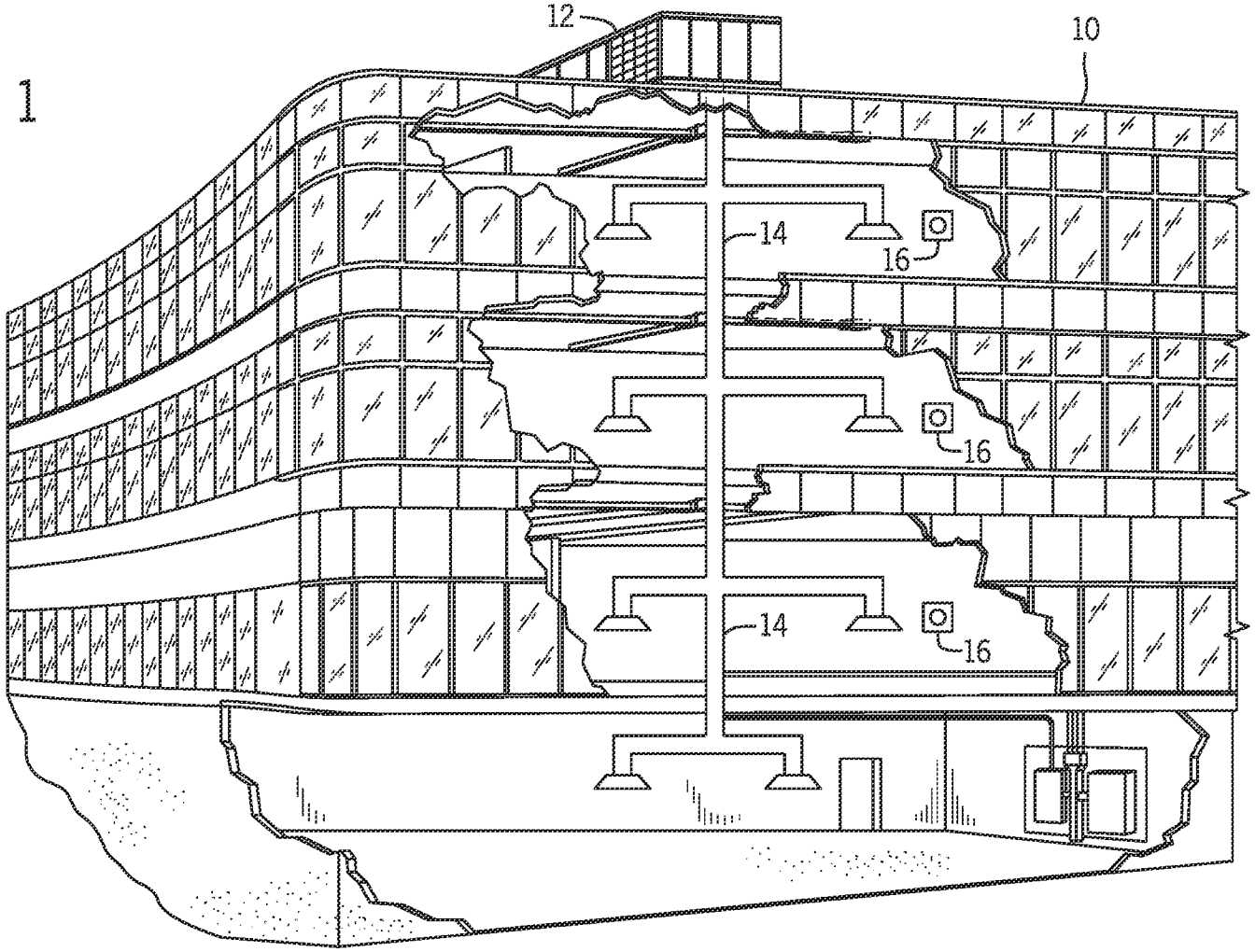
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Heating, ventilation, and air conditioning (HVAC) systems often include heat exchangers for heating, cooling, and/or dehumidifying air before it is delivered to a conditioned space. Generally, a heat exchanger operates by circulating a working fluid through a set of tubes. For example, in some embodiments, a heat exchanger may be a furnace configured to circulate combustion products through tubes of the furnace. One or more blowers of the HVAC system direct an air flow across the tubes, and heat is transferred between the air flow and the working fluid directed through the tubes of the heat exchanger. During the heat transfer process, distribution of the air flow across the tubes may impact the exchange of heat between the working fluid and the air flow. Uneven distribution of air flow may result in certain portions of the tubes contacting less air flow than other portions of the tubes. Consequently, portions of the tubes that contact less air flow may not transfer as much heat to the air flow, which may cause different portions of the tubes to experience different temperatures. For example, portions of the tubes may experience periods of sustained, heightened temperatures relative to other portions of the tubes. Over time, these areas of heightened temperature, or "hot spots," may degrade the material of the tubes, thereby reducing a useful life of the heat exchanger. In some instances, hot spots may form in a bend region of the tubes. Additionally, the heat exchanger may not transfer as much heat to the air flow at the hot spots, resulting in less efficient operation of the heat exchanger. To reduce the formation of hot spots, HVAC systems may include baffles to promote more even air flow distribution across the heat exchanger.

Generally, baffles may be walls or panels positioned adjacent to a heat exchanger to direct air flow along a desired flow path. The baffles may be designed, selected, positioned, or otherwise configured to enable and promote flow of air across the tubes of a heat exchanger. Unfortunately, conventional baffles utilized with heat exchangers may be susceptible to inefficiencies. For example, conventional baffles may cause the formation of eddies (e.g., swirling) from the air flow. Conventional baffles may also cause formation of "dead space" near the baffles and/or heat exchanger that inhibits desirable air flow through the HVAC system. The eddies and/or "dead space" may reduce flow of air across the tubes of the heat exchanger and/or may increase air flow resistance within the HVAC system. To overcome these inefficiencies, a blower of the HVAC system may operate at a greater capacity in order to overcome losses caused by the eddies and/or "dead space" and supply a desired amount of air flow. As will be appreciated, operating the blower at a greater capacity may result in increased power usage. Therefore, it is desirable to reduce formation of eddies and "dead space" induced by traditional baffles.

Accordingly, present embodiments are directed to an improved baffle for use with a heat exchanger in an HVAC system. As discussed below, the improved baffle may include a geometry, arrangement, and/or configuration (e.g., within the HVAC system) that mitigates the formation of eddies and "dead space" within the HVAC system. Thus, the improved baffle may direct air flow more evenly across tubes of the heat exchanger. In this way, the present embodiments enable improved operation of the heat exchanger and HVAC system overall by reducing eddy effects, reducing formation of hot spots in the heat exchanger, and improving efficiency of the HVAC system.

Turning now to the drawings, FIG. 1 is a perspective view of an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
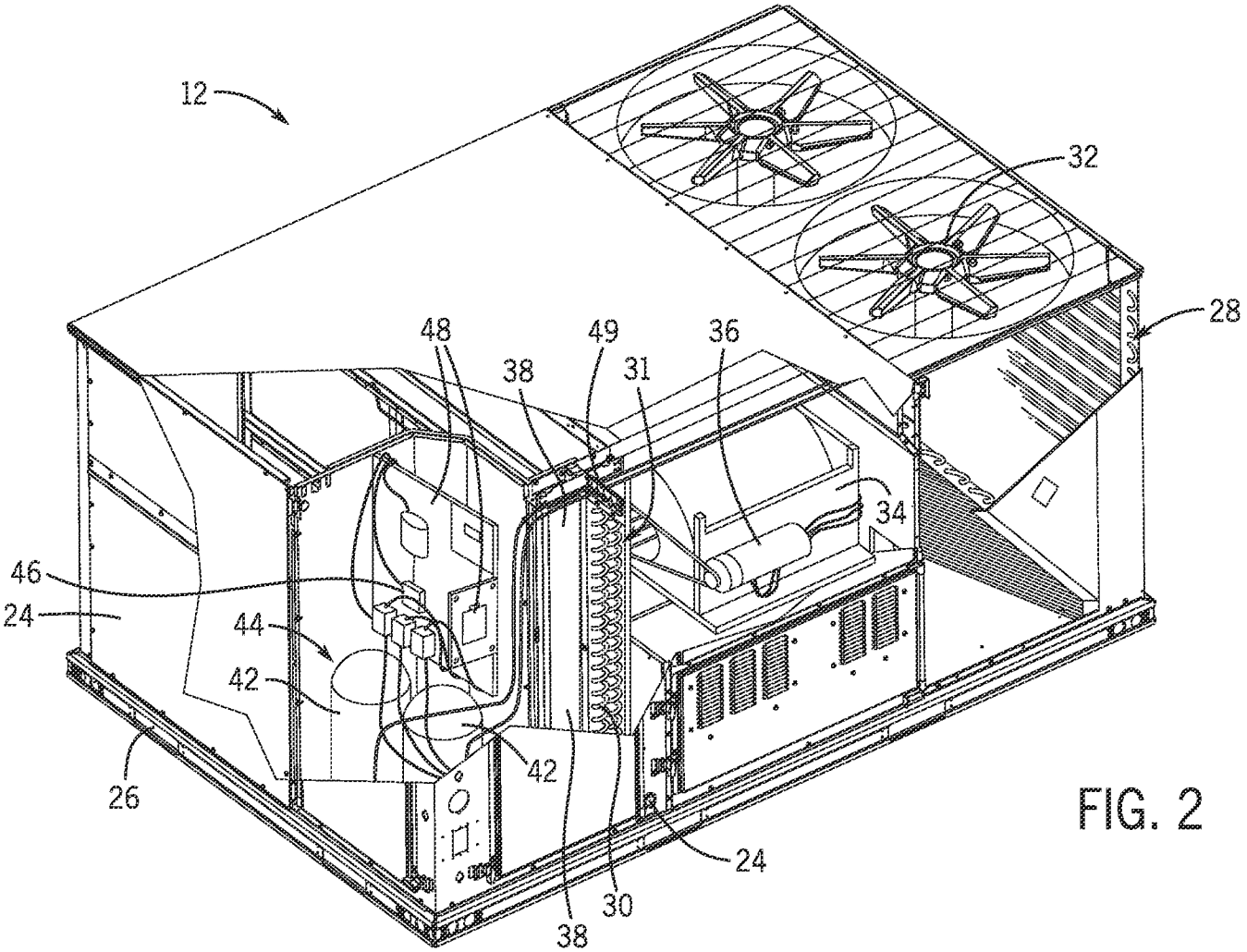
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
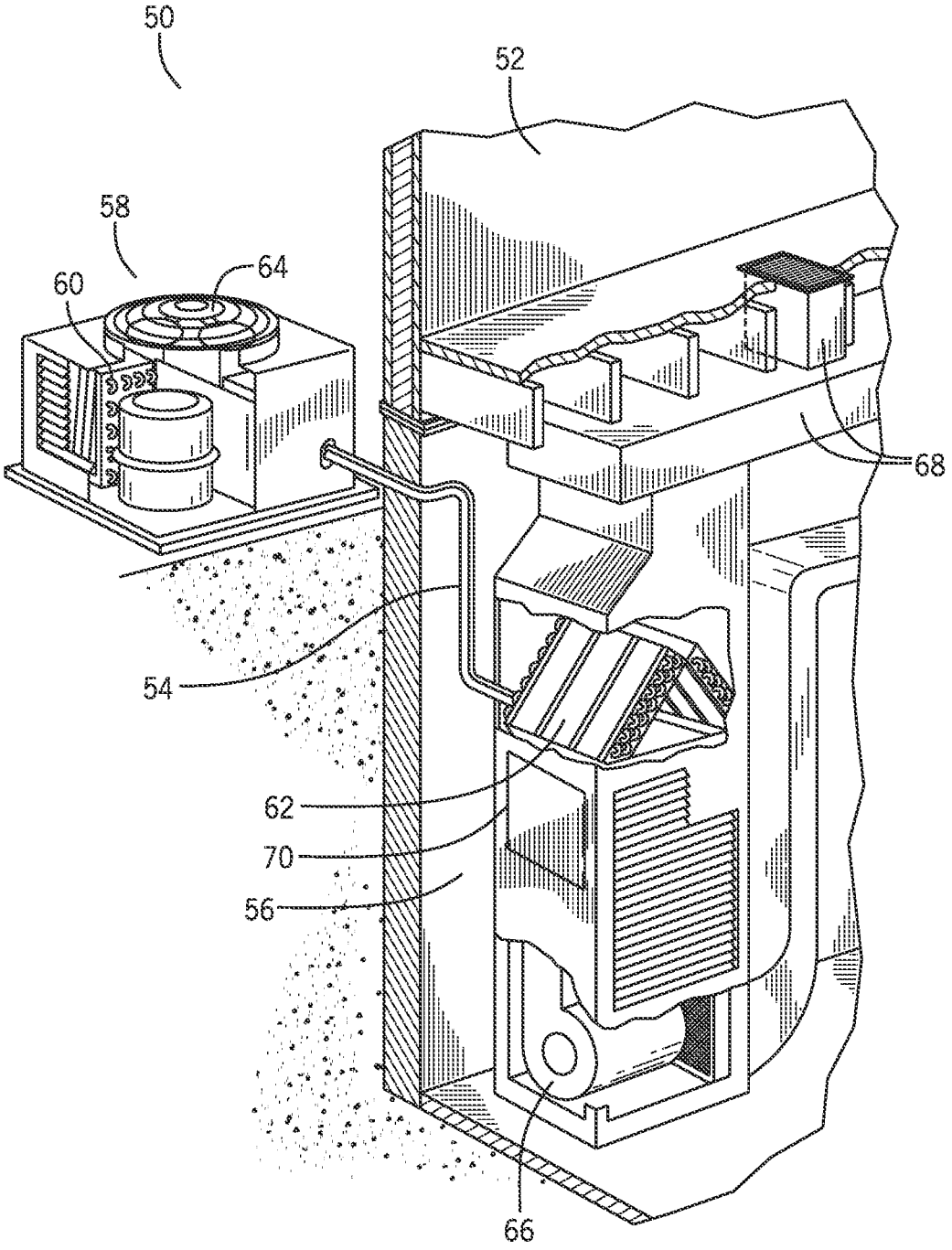
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
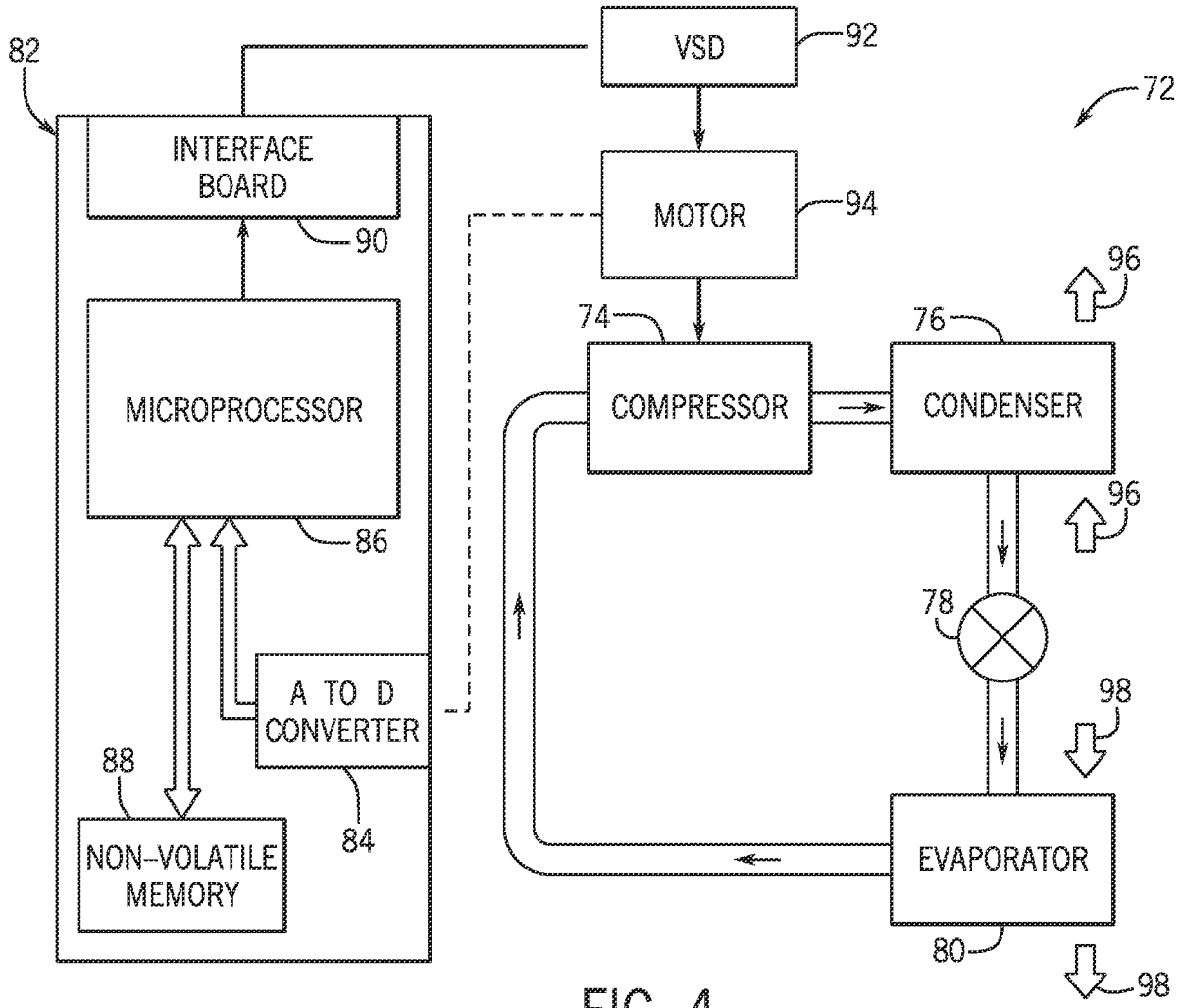
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, present embodiments are directed to improved baffles for a heat exchanger of an HVAC system, such as the HVAC unit 12 or the heating and cooling system 50 discussed above. The baffles may be placed within a furnace assembly to direct air flow over heat exchanger tubes and reduce formation of eddies and/or "dead space" within the HVAC system (e.g., adjacent to the heat exchanger). For example, the baffles may be installed with the furnace system 70 of the indoor unit 56 described above. As discussed in detail below, an angled geometry of the baffle may impede air from forming an eddy within the indoor unit 56 (e.g., at a base of the baffle). Additionally, the angled geometry of the baffle may direct air flow toward the tubes of a heat exchanger of the furnace system 70. In this way, present embodiments of the baffle may reduce hot spots and dead space in the furnace system 70, thereby improving efficiency of the heating and cooling system 50. Further, it should be appreciated that the disclosed embodiments may be utilized in any suitable HVAC system having a heat exchanger. While the following discussion describes improved baffles incorporated with furnace systems and heat exchangers, the improved baffles described herein may be utilized with other heat exchangers in an HVAC system.

Figure 5:
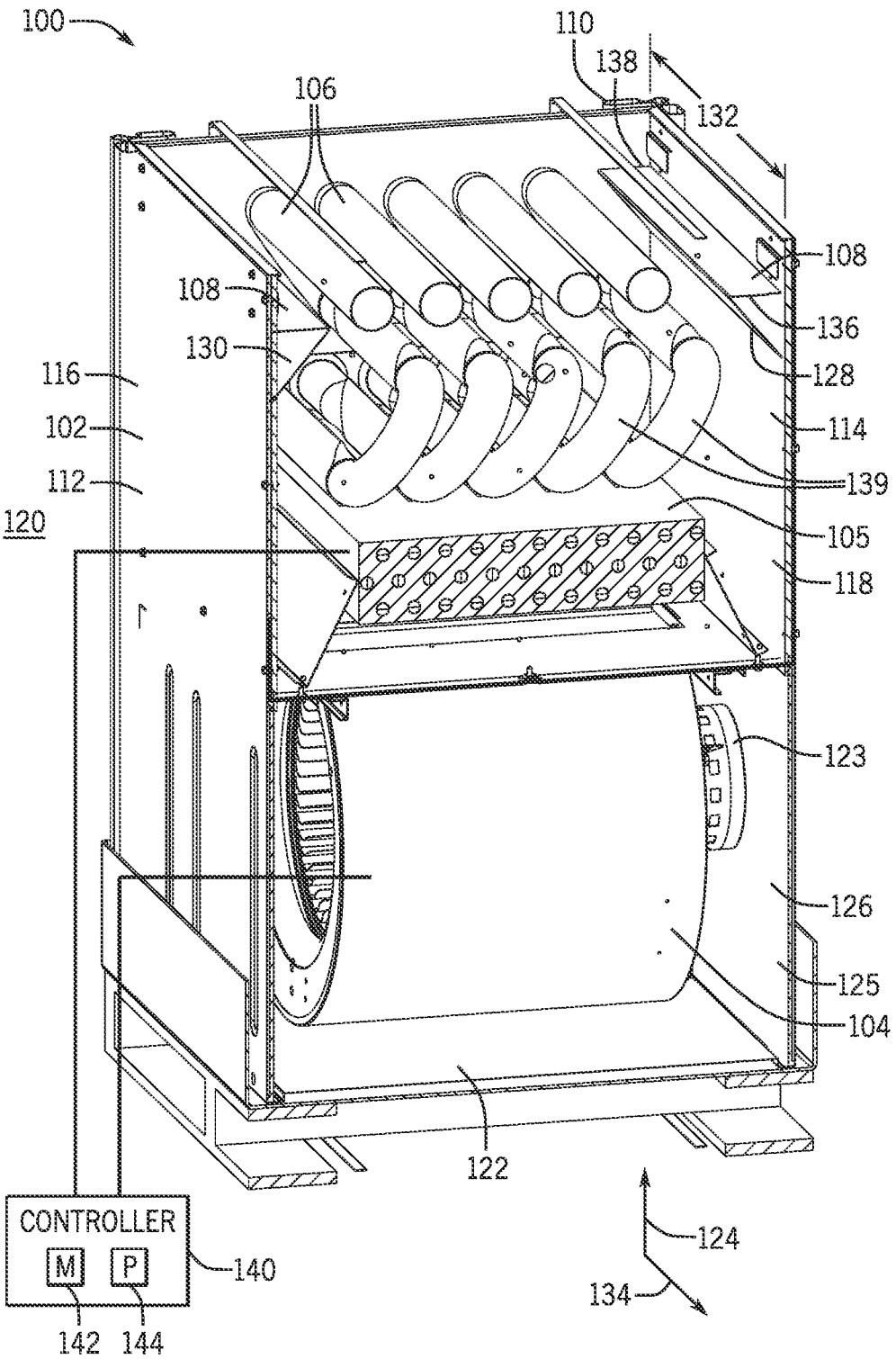
FIG. 5 is a perspective view of an embodiment of an HVAC system, illustrating a heat exchanger and baffles of the HVAC system, in accordance with aspects of the present disclosure.

FIG. 5 is a perspective view of an embodiment of a furnace 100 of an HVAC system (e.g., the heating and cooling system 50), in accordance with the presently disclosed techniques. For example, the furnace 100 may be a residential furnace system, such as the furnace system 70. The furnace 100 may include a housing 102, a blower 104, a heat exchanger 105, and one or more baffles 108. The heat exchanger 105 may include tubes 106 configured to circulate combustion products therethrough. In other embodiments, the heat exchanger 105 may circulate a refrigerant or other working fluid. In operation, the blower 104 forces an air flow across the heat exchanger 105, and the heat exchanger 105 transfers heat to the air flow prior to directing the air flow to a conditioned space. The furnace 100 may direct the air flow towards conditioned space via an outlet 110 of the housing 102.

The housing 102 may be formed of a plurality of panels 112 (e.g., walls, front panel, top panel, side panels, etc.), such as a first side panel 114 and a second side panel 116. The housing 102 may be formed of a single material (e.g., metal). In certain embodiments, the panels 112 may be attached to one another via welding, fasteners, or another suitable method of attachment. In certain embodiments, the housing 102 may form a rectangular prism or another suitable shape. The panels 112 of the housing 102 may define an interior volume or plenum 118 of the furnace 100. The first side panel 114 may be disposed opposite the second side panel 116 relative to the interior volume 118. The housing 102 may also separate the interior volume 118 from an exterior environment 120. In certain embodiments, the exterior environment 120 may be an outdoor space, a conditioned space, a utility area of a building, or another suitable location. The exterior environment 120 may contain other components of an HVAC system that interface or interact with the furnace 100 (e.g., a burner, a controller, a compressor, an air handling unit, the blower 104, etc.). The housing 102 may include one or more inlets for receiving air (e.g., supply air, primary air, etc.) from a conditioned space, an outdoor environment (e.g., the exterior environment 120), or another suitable air source. The housing 102 may contain components of the furnace 100, such as the blower 104, the tubes 106, and the one or more baffle 108 within the interior volume 118.

The components included in the interior volume 118 of the housing 102 may operate to heat an air flow directed through the housing 102. For example, the blower 104 may be operated to direct (e.g., force, draw, etc.) air toward the tubes 106 of the heat exchanger 105. In certain embodiments, the blower 104 may be disposed adjacent to a bottom panel 122 of the plurality of panels 112. The blower 104 may couple to the housing 102 via a blower support 123. In other embodiments, the blower 104 may be disposed external to the housing 102. In certain embodiments, the blower 104 may draw air into the interior volume 118 and direct the air toward the tubes 106 along a direction or axis 124 (e.g., an axis of an air flow path extending through the housing 102). The axis 124 may be generally aligned with a direction of gravity. The blower 104 may draw air from outside the housing 102 (e.g., the exterior environment 120), from ductwork fluidly coupled to the housing 102, and/or from another source of air.

In the illustrated embodiment, the tubes 106 of the heat exchanger 105 are positioned downstream of the blower 104 along the axis 124 (e.g., relative to direction of air flow through the housing 102). However, in other embodiments, the blower 104 may be positioned downstream of the heat exchanger 105. In certain embodiments, the blower 104 may direct a variable amount of air flow across the tubes 106 of the heat exchanger 105. For example, the blower 104 may be operated at a particular speed based on a call for conditioning, a set point temperature of a conditioned space serviced by the furnace 100, a measured temperature of the conditioned space, a capacity of the furnace 100, another suitable operating parameter of the HVAC system having the furnace, or any combination thereof.

The tubes 106 may be positioned at any suitable location along the axis 124 relative to the blower 104 within the interior volume 118. The tubes 106 may be formed from a metal (e.g., steel) and may be hollow to enable flow of a working fluid (e.g., combustion products) therethrough. Further, the tubes 106 may be curved to define multiple passes across which the air may flow. For example, each of the tubes 106 may be formed into an "S" shape configuration to define three passes of the heat exchanger 105. The tubes 106 may receive a working fluid (e.g., combustion products) from a burner of the furnace 100. In certain embodiments, the burner may be disposed within the housing 102. In other embodiments, the burner may be disposed external to the housing 102 (e.g., in the exterior environment 120). The working fluid may flow through the tubes 106 and enable transfer of heat to the air delivered by the blower 104. In certain embodiments, the furnace 100 may include insulation 125 (e.g., an insulation layer) disposed on an interior surface 126 of the housing 102. The insulation 125 may be fiberglass insulation, foam insulation, cellulose insulation, or another suitable insulation material. Further, the insulation 125 may include a reinforcement layer (e.g., aluminum layer) on inner and/or outer (e.g., first and/or second) sides of the insulation 125. In certain embodiments, the insulation 125 may be attached to the interior surface 126 via an adhesive, pin welding, or both.

The one or more baffles 108 may be disposed within the housing 102 to direct and/or guide air from the blower 104 toward the tubes 106. Each of the baffles 108 may be attached to one or more the panels 112 on the interior surface 126. For example, a first baffle 128 may be attached (e.g., mounted) to the first side panel 114, and a second baffle 130 may be attached (e.g., mounted) to the second side panel 116. As shown, the first baffle 128 may be disposed opposite the second baffle 130 relative to the tubes 106 of the heat exchanger 105. Additionally, the first and second baffles 128, 130 may be disposed at a common location along the axis 124. As shown, the first and second baffles 128, 130 are also disposed at a common location with the tubes 106 of the heat exchanger 105 along the axis 124. In other words, the tubes 106 and the first and second baffles 128, 130 overlap with one another along the axis 124.

The baffles 108 may extend along a depth 132 of the interior volume 118 (e.g., along a direction or axis 134). The baffles 108 may each extend along the depth 132 from a first baffle end 136 to a second baffle end 138 disposed opposite the first baffle end 136. In certain embodiments, the first baffle end 136 and the second baffle end 138 may each be coupled to the interior surface 126 of the housing 102 (e.g., coupled to opposing panels 112 of the housing 102). As the baffles 108 may each extend along the depth 132 (e.g., an entirety of the depth 132), the baffles 108 may each overlap (e.g., fully or substantially fully overlap) with the tubes 106 along the axis 134. As a result, air flow may be more evenly directed across the tubes 106 across the depth 132 of the interior volume 118. For example, improved or increased air flow may be directed across bends 139 of the tubes 106, which may decrease formation of hot spots at the bends 139 of the tubes 106 and heat transfer between the heat exchanger 105 and the air flow may be improved. However, in other embodiments, the first baffle end 136 and second baffle end 138 may be spaced apart from the interior surface 126. The baffles 108 may be formed of any suitable material (e.g., metal, polymer, etc.) and may have an angled geometry to direct air blown by the blower 104 across the tubes 106. The geometry of the baffles 108 is described in further detail below.

A controller 140 (e.g., control panel 82 discussed above) may regulate operation of one or more components of the furnace 100 (e.g., the blower 104, the heat exchanger 105, a burner of the furnace 100, etc.). The controller 140 may include a memory 142 and processing circuitry 144 (e.g., one or more microprocessors). The processing circuitry 144 may be configured to execute software (e.g., processor-executable instructions), such as software for controlling the blower 104. Moreover, the processing circuitry 144 may include multiple microprocessors, one or more "general-purpose" microprocessors, and/or one or more special-purpose microprocessors. The memory 142 may include a volatile memory, such as random access memory (RAM), and/or a nonvolatile memory, such as read-only memory (ROM). The memory 142 may store a variety of information and may be used for various purposes. For example, the memory 142 may store processor-executable instructions (e.g., firmware or software) for the processing circuitry 144 to execute. In certain embodiments, the controller 140 may be disposed within the interior volume 118 of the furnace 100. In other embodiments, the controller 140 may be disposed outside of the furnace 100 (e.g., in the exterior environment 120).

As discussed above, the baffles 108 are arranged to reduce formation of eddies formation in an air flow generated by the blower 104. Additionally, the baffles 108 are arranged to more evenly distribute the air flow across the tubes 106. In this way, the baffles 108 promote improved air flow through the furnace 100 and improved heat exchange between the air flow and the heat exchanger 105. The configuration and arrangement of the baffles 108 within the furnace 100 is discussed further below.

Figure 6:
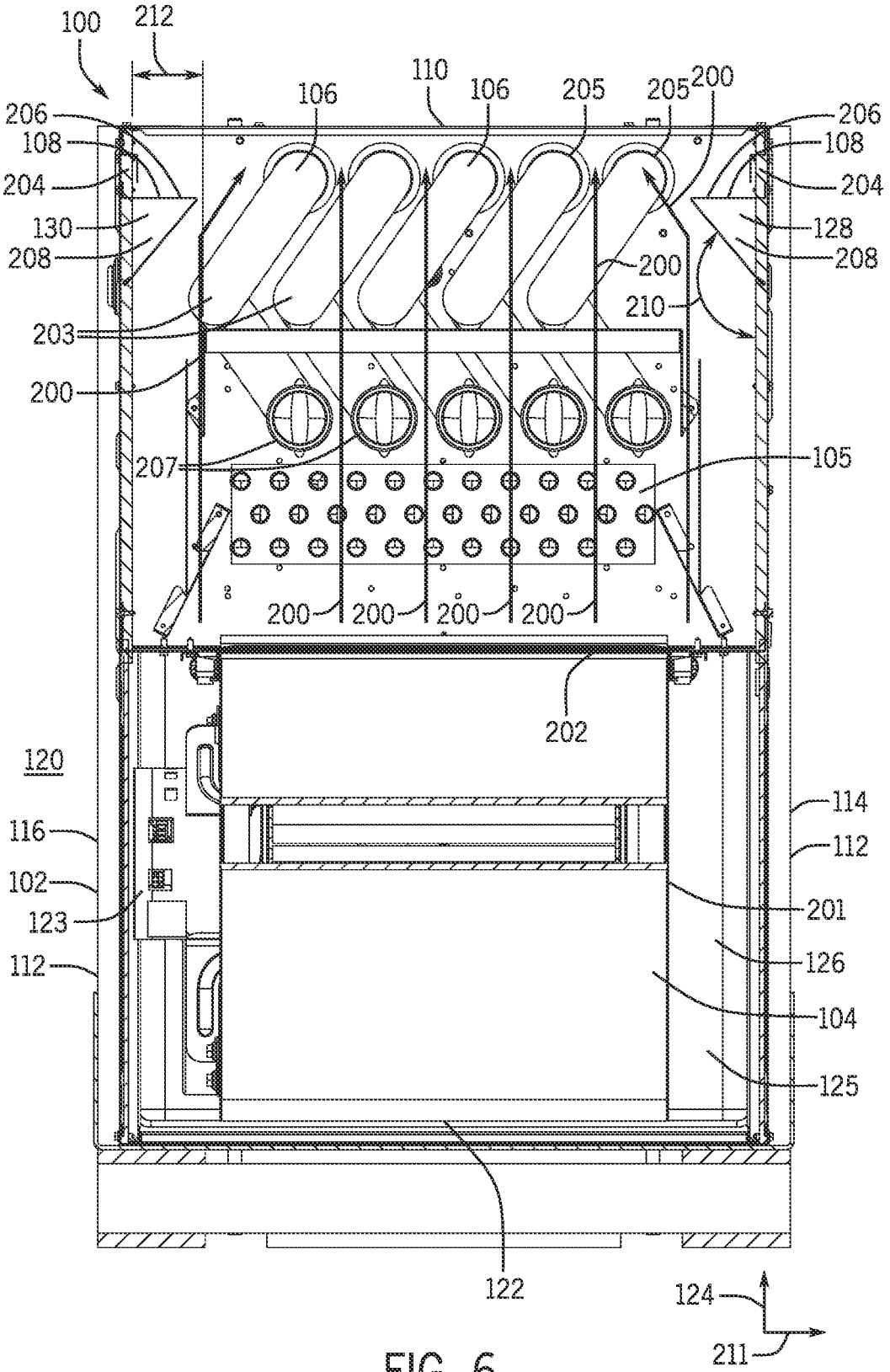
FIG. 6 is a section view of an embodiment of an HVAC system including a heat exchanger and baffles, illustrating air flow through the HVAC system, in accordance with aspects of the present disclosure.

FIG. 6 is a cross-sectional side view of an embodiment of the furnace 100, illustrating an air flow 200 (e.g., an air flow path) extending through the furnace 100. For example, the air flow 200 may be generated by the blower 104 and may be directed through the furnace 100 to enable transfer of heat from the tubes 106 of the heat exchanger 105 to the air flow 200. The blower 104 may receive air through a blower inlet 201 and discharge the air flow 200 along the axis 124 via a blower outlet 202. From the blower outlet 202, the air flow 200 is directed across the tubes 106 of the heat exchanger 105. As mentioned above, the furnace 100 includes the baffles 108 coupled to panels 112 of the housing 102 to further direct the air flow 200 across the tubes 106. In traditional embodiments, baffles utilized with a heat exchanger may cause air flow to become turbulent, which may create eddies in the air flow. The presence of eddies and turbulence may result in a less efficient transfer of heat from the heat exchanger to the air flow and/or may increase system power consumption. Accordingly, the baffles 108 of the present disclosure are configured to reduce turbulence and eddy formation. The reduction in eddy formation may increase efficiency of heat transfer between the tubes 106 and the air flow 200. Additionally, the decrease in air flow resistance enabled by the baffles 108 may reduce power consumed by the blower 104 during operation of the furnace 100.

In certain embodiments, the baffles 108 may be secured to the housing 102 such that the baffles 108 are aligned with the tubes 106 (e.g., the heat exchanger 105) along the axis 124 (e.g., a direction of the air flow 200). In other words, the baffles 108 overlap with the tubes 106 of the heat exchanger 105 along the axis 124. In the illustrated embodiment, the baffles 108 are each generally aligned (e.g., along the axis 124) at least partially with a second pass 203 (e.g., intermediate pass) and a third pass 205 (e.g., a furthest downstream pass) of the tubes 106. Further, the baffles 108 are each disposed downstream of a first pass 207 (e.g., a furthest upstream pass) of the tubes 106. In other words, the baffles 108 are offset from the first pass 207 of the tubes 106 (e.g., in a downstream direction) relative to the axis 124. Thus, the baffles 108 may direct the air flow 200 to more evenly flow across the second pass 203 and/or the third pass 205 of the tubes 106, thereby reduce formation of hot spots on the second pass 203 and/or the third pass 205 of the tubes 106 and improving heat transfer between the heat exchanger 105 and the air flow 200. However, in other embodiments, the baffles 108 may be aligned with additional and/or alternative passes of the tubes 106.

Each of the baffles 108 may include a flange 204 (e.g., a mounting flange, a first flange, etc.) that may be secured to the housing 102 (e.g., one of the panels 112) of the furnace 100. For each baffle 108, a first baffle panel 206 (e.g., a first panel) may extend from the flange 204 into the interior volume 118 (e.g., the air flow path) and towards the tubes 106. In certain embodiments, the first baffle panel 206 may extend generally perpendicularly from the housing 102 in an installed configuration. A second baffle panel 208 (e.g., a second panel) of each baffle 108 may extend from the first baffle panel 206 toward the housing 102 (e.g., toward the panel 112 to which the baffle 108 is secured). In certain embodiments, the second baffle panel 208 may extend from the first baffle panel 206 at least partially in an upstream direction (e.g., relative to a direction of the air flow 200, at an oblique angle relative to the axis 124, etc.). Thus, in some embodiments, the flange 204 may be disposed further downstream from the blower 104 along the axis 124 than the first baffle panel 206 and the second baffle panel 208. The second baffle panel 208 may extend from the first baffle panel 206 to the panel 112 to which the baffle 108 is secured (e.g., via the flange 204). For example, the second baffle panel 208 may extend to the panel 112 and abut the panel 112 to which it is coupled. In other embodiments, the second baffle panel 208 may extend to the panel 112 and be attached (e.g., via mechanical fasteners) to the panel 112.

The flange 204, the first baffle panel 206, and the second baffle panel 208 may each be generally flat and/or planar members. In certain embodiments, the second baffle panel 208 may be a curved member. For example, the second baffle panel 208 may curve generally along a plane defined by the axis 124 and an axis 211. The axis 211 may extend in a generally horizontal, lateral, or crosswise direction with respect to the axis 124. In some embodiments, the second baffle panel 208 may have a generally concave geometry relative to the interior volume 118 and/or relative to the air flow 200. In certain embodiments, the flange 204, the first baffle panel 206, and the second baffle panel 208 of the baffle 108 may be integrally formed from a single piece of material. For example, the baffle 108 may be formed via a sheet metal bending process. In other embodiments, the flange 204, the first baffle panel 206, and the second baffle panel 208 may be separate pieces of material attached to one another via welding, fasteners, or another suitable method of attachment.

In an installed configuration, the second baffle panel 208 may be angled (e.g., relative to the axis 124) to reduce formation of eddies and to direct the air flow 200 toward the tubes 106. The second baffle panel 208 may be angled relative to the housing 102, as well as the axis 124, by an angle 210. Thus, the second baffle panel 208 may generally face the air flow 200 directed through the housing 102, such that the air flow 200 may impinge against the second baffle panel 208 and be directed toward the tubes 106 of the heat exchanger 105. In some embodiments, the angle 210 may be between approximately 130 degrees and 140 degrees. As illustrated, as the air flow 200 reaches the second baffle panel 208 of each baffle 108, the air flow 200 impinges against the second baffle panel 208 and is directed away from the panels 112 and towards the tubes 106 (e.g., inward relative to the housing 102). Additionally, as the second baffle panel 208 may abut the panel 112 to which it is secured, the baffle 108 may block bypass of the air flow 200 (e.g., between the baffle 108 and the panel 112 to which it is secured).

Due to the angled geometry of the second baffle panels 208, the air flow 200 may remain laminar before, during, and/or after contact with the second baffle panels 208, and eddy formation may be reduced. Furthermore, the first baffle panel 206 extending crosswise (e.g., generally perpendicularly) from the panel 112 may also reduce formation of eddies in the air flow 200. For example, the first baffle panel 206 may block the air flow 200 from recirculating or flowing in an upstream direction (e.g., between the baffle 108 and the panel 112) after the air flow 200 flows downstream of the baffle 108 in along the axis 124. The presence of the baffles 108 may enable all or substantially all of the air flow 200 to flow across and/or towards the tubes 106. In other words, the baffles 108 reduce bypass of the air flow 200 around the tubes 106 of the heat exchanger 105. For example, in the illustrated embodiment, air flow 200 through a gap 212 between the tubes 106 and the housing 102 may be blocked via the baffles 108, thereby increasing an amount of the air flow 200 that is directed across the tubes 106. As a result, increased heat exchanger from the tubes 106 to the air flow 200 is enabled. Additionally, the increased amount of air flow 200 directed across the tubes 106, as compared to traditional systems having conventional baffles, reduces uneven temperature distribution and/or formation of hot spots in the tubes 106.

Figure 7:
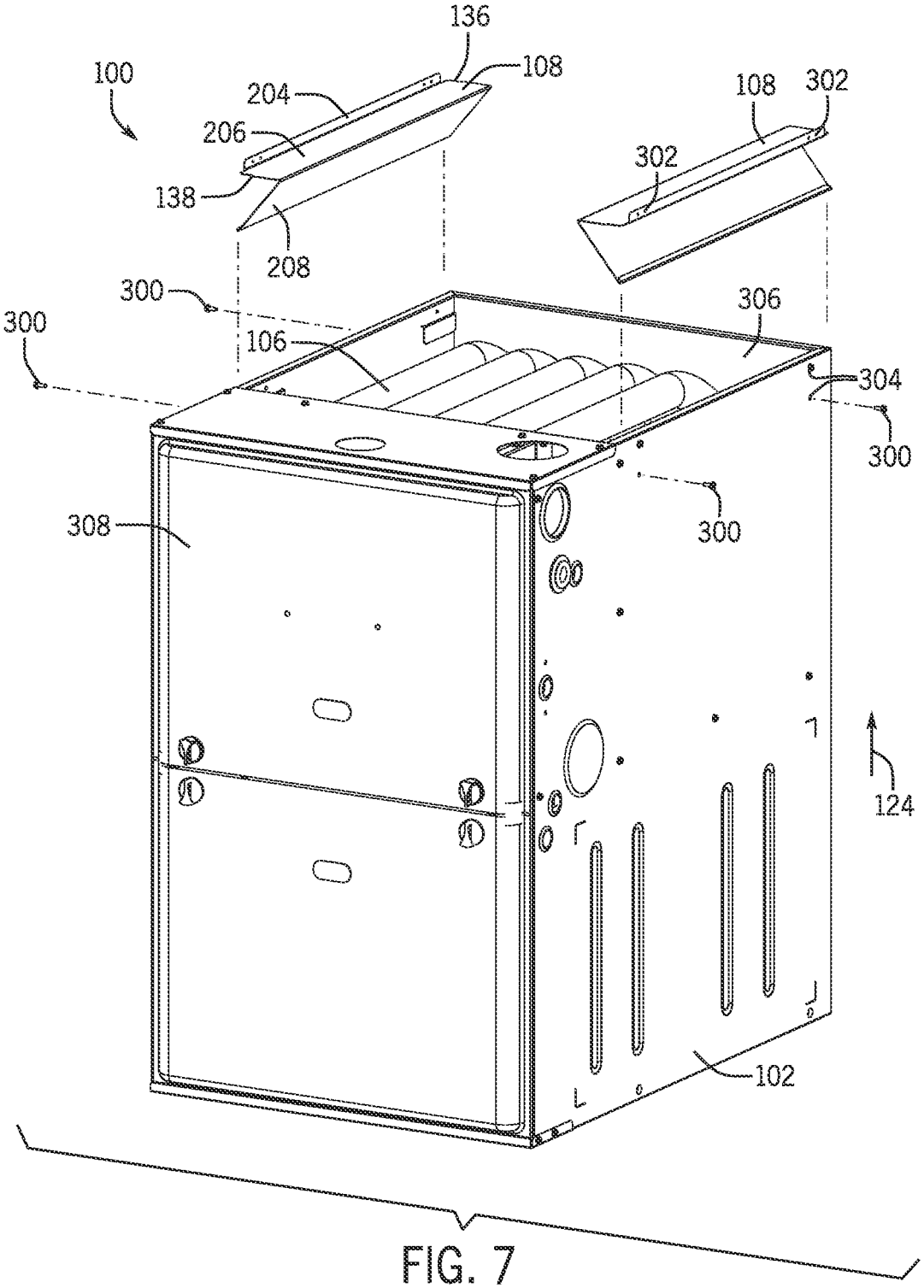
FIG. 7 is an exploded perspective view of an embodiment of an HVAC system, illustrating baffles of the HVAC system, in accordance with aspects of the present disclosure.

The baffles 108 may be secured to the housing 102 in any suitable manner. For example, the baffles 108 may be removably coupled to the housing 102 (e.g., the panels 112). For example, FIG. 7 is an exploded perspective view of an embodiment of the furnace 100, illustrating a technique for coupling the baffles 108 to the housing 102. Specifically, each baffle 108 may be attached to one of the panels 112 of the housing 102 via a plurality of fasteners 300. The fasteners 300 may be rivets, bolts, screws, or another suitable fastener. Respective fasteners 300 may secure each of the baffles 108 to one of the panels 112 via a first plurality of mounting holes 302 (e.g., apertures, openings, housing holes, etc.) formed in one of the panels 112 and a second plurality of mounting holes 304 (e.g., apertures, openings, baffle holes, etc.) formed in the flange 204 of the respective baffle 108. That is, each fastener 300 may extend through one of the a first plurality of mounting holes 302 and one of the second plurality of mounting holes 304 to secure the baffle 108 to one of the panels 112.

In certain embodiments, one or more of the first plurality of mounting holes 302 may be disposed adjacent the first baffle end 136 and one or more of the first plurality of the mounting holes 302 may be disposed adjacent the second baffle end 138. The second plurality of mounting holes 304 may be formed in the panel 112 to align with the first plurality of baffle holes 302, such that the baffle 108 is secured to the panel 112 in a desired location within the interior volume 118 in an installed configuration. In certain embodiments, the panel 112 may include multiple sets of the second plurality of mounting holes 304. For example, different sets of the second plurality of mounting holes 304 may be formed in the panel 112 at different locations along the axis 124. In this way, the baffle 108 may be secured to the panel 112 at different positions. A mounting location of the baffle 108 on the panel 112 may be selected based on a variety of design considerations, such as a capacity of the furnace 100, an air flow rate or range of air flow rates enabled by the blower 104, a number of passes of the tubes 106 of the heat exchanger 105, a desired position of the baffle 108 relative to the tubes 106 (e.g., one or more tube passes) of the heat exchanger 105, another suitable factor or operating parameter of the furnace 100, or any combination thereof. In certain embodiments, the mounting holes 302, 304 may include one or more sets of holes of varying sizes to accommodate different sizes of fasteners 300. As illustrated, the first baffle end 136 of each baffle 108 may be spaced (e.g., offset) from a rear panel 306 of the housing 102, and/or the second baffle end 138 of each baffle 108 may be spaced (e.g., offset) from a front panel 308 of the housing 102. In certain embodiments, the second baffle end 138 may be spaced further from the front panel 308 than the first baffle end 136 is spaced from the rear panel 306, or vice versa. Further, as discussed above, in some embodiments, the first baffle end 136 may contact the rear panel 306 and/or the second baffle end 138 is spaced from the front panel 308 in an installed configuration of the baffle 108.

Figure 8:
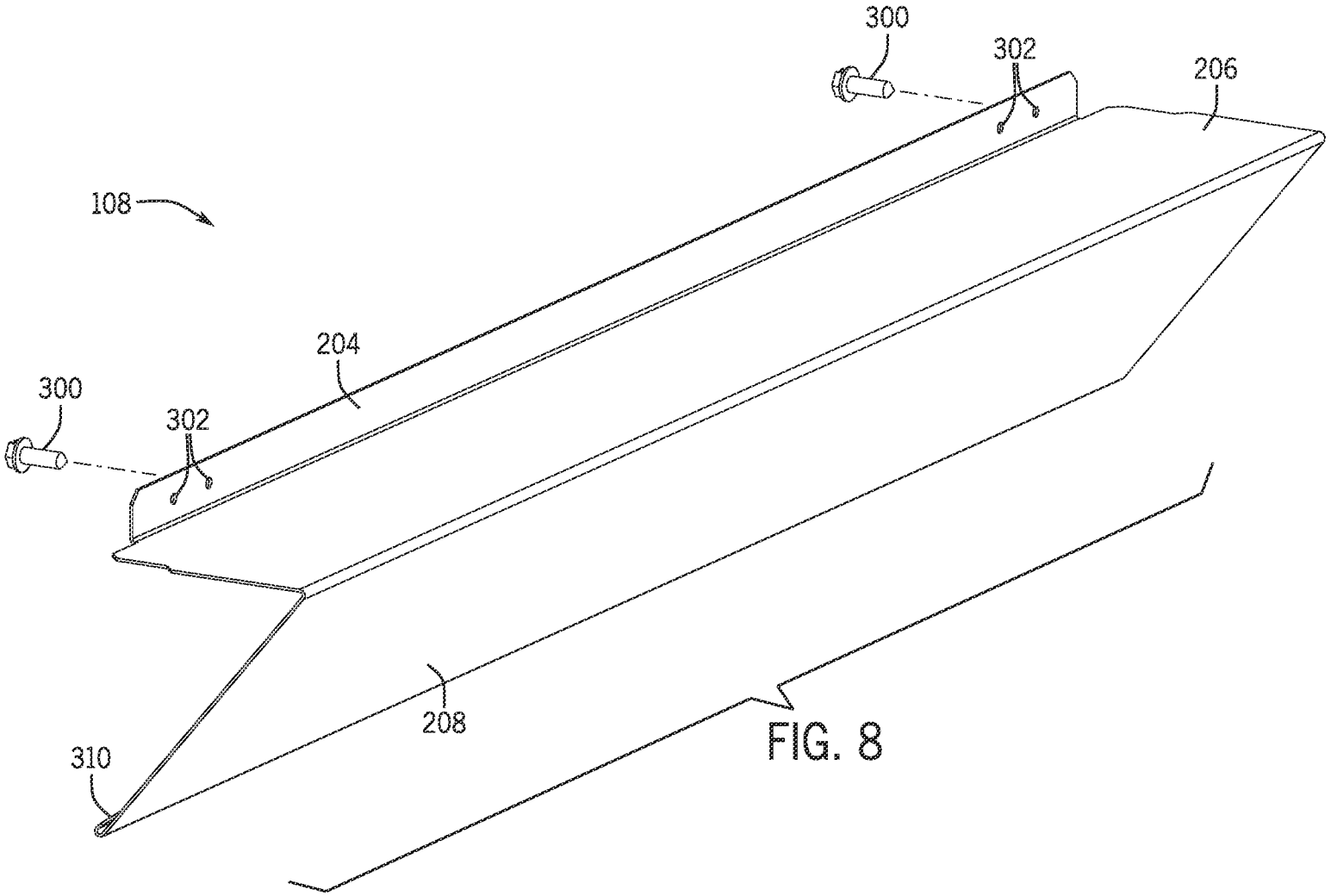
FIG. 8 is a perspective view of an embodiment of a baffle of an HVAC system, in accordance with aspects of the present disclosure.

FIG. 8 is a perspective view of an embodiment of one of the baffles 108 of the furnace 100. In addition to the flange 204, the first baffle panel 206, and the second baffle panel 208, the baffle 108 may also include a flange 310 (e.g., a second flange, an abutting flange, etc.) extending from the second baffle panel 208. For example, the flange 310 may extend from the second baffle panel 208 generally toward the first baffle panel 206. For example, the flange 310 may extend from the second baffle panel 208 and toward the first baffle panel 206 at an acute angle (e.g., at an angle of approximately 1, 2, 3, 4, 5, 10, 15, 20, or 25 degrees relative to the second baffle panel 208). In some embodiments, the flange 310 may extend from the second baffle panel 208 and be generally parallel and/or aligned (e.g., within 1, 2, 3, 4, or 5 degrees, along the axis 124, etc.) with the flange 204. For example, the flange 310 may extend from the second baffle panel 208 and be generally aligned with the flange 204 in an embodiment of the baffle 108 configured to be attached to the panel 112 via first fasteners 300 extending through the flange 204 and the panel 112 and via second fasteners 300 extending through the flange 310 and the panel 112.

In certain embodiments, the flange 204, the first baffle panel 206, the second baffle panel 208, and the flange 310 may be integrally formed as a single piece of material, such as sheet metal. In other embodiments, one or more of the flange 204, the first baffle panel 206, the second baffle panel 208, and the flange 310 may be formed as separate pieces that are secured to one another via welding, fasteners, or another suitable method of attachment. In certain embodiments, the flange 310 may rest against, be biased against, or may otherwise abut the interior surface 126 of the housing 102 (e.g., the panel 112 to which the baffle 108 is attached) to block the air flow 200 from flowing between the baffle 108 and the panel 112 to which the baffle 108 is secured during operation of the furnace 100. In other embodiments, the flange 310 may abut the insulation 125 of the housing 102 in an installed configuration of the baffle 108.

Figure 9:
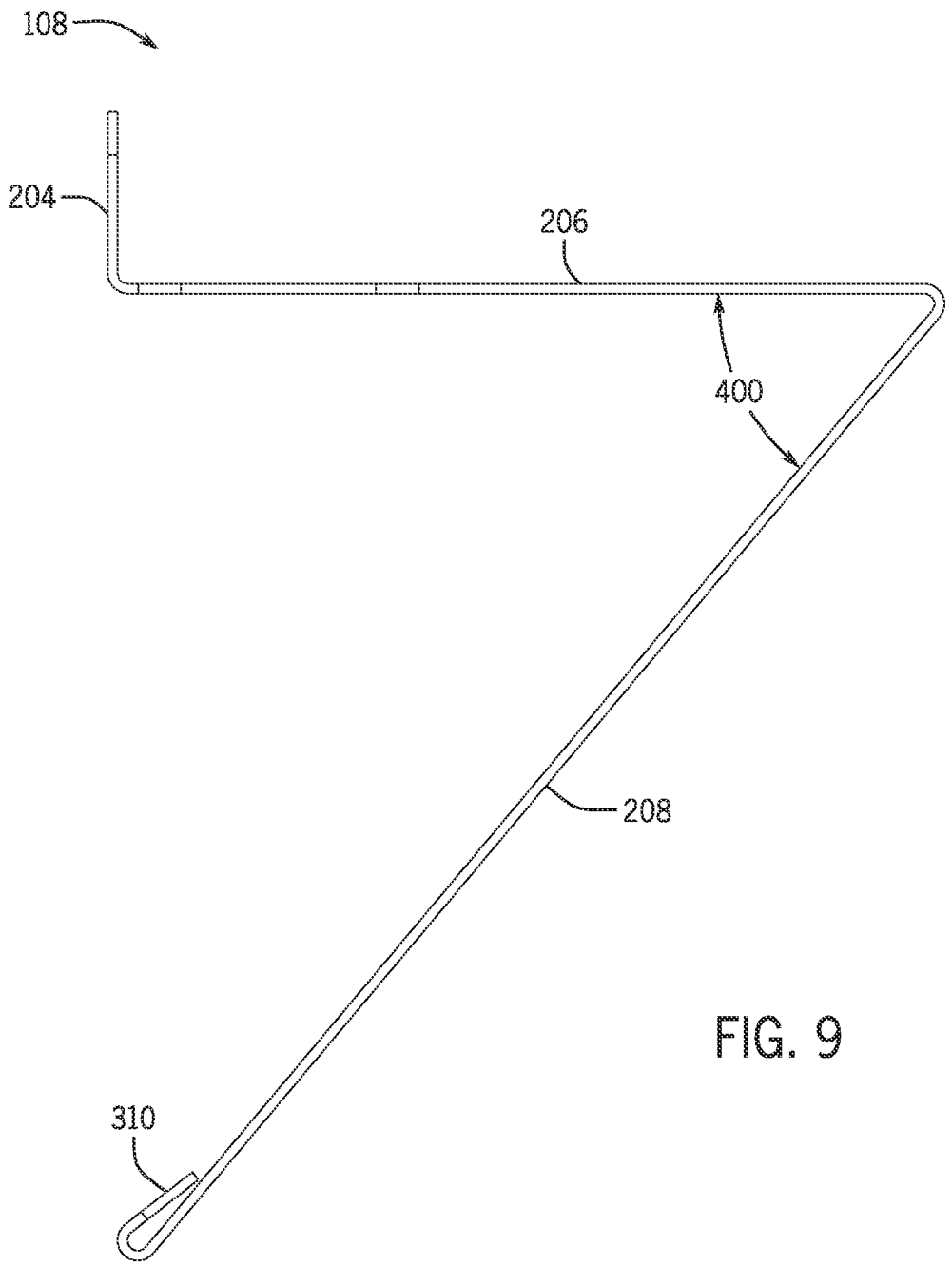
FIG. 9 is a side view of an embodiment of a baffle of an HVAC system, in accordance with aspects of the present disclosure.

FIG. 9 is a side view of an embodiment of the baffle 108, illustrating the flange 204, the first baffle panel 206, second baffle panel 208, and the flange 310. In the illustrated embodiment, the second baffle panel 208 extends from the first baffle panel 206 at an angle 400. As discussed above, in an installed configuration of the baffle 108 with the furnace 100, the flange 204 may be secured to one of the panels 112, and the first baffle panel 206 may extend from the panel 112 and into the interior volume 118 (e.g., toward the tubes 106 of the heat exchanger 105). For example, the first baffle panel 206 may extend generally perpendicularly from the panel 112. In certain embodiments, the angle 400 may be between approximately 30 degrees and 60 degrees, between approximately 40 degrees and 50 degrees, approximately 45 degrees, or any other suitable angle. In some applications, a magnitude of the angle 400 may be selected based on a size of the furnace 100, a size of the heat exchanger 105, an expected flow rate or range of flow rates of the air flow 200, a magnitude or size of the gap 212, another suitable factor or operating parameter of the furnace 100, or any combination thereof.

As set forth above, embodiments of the present disclosure may provide one or more technical effects useful for reducing eddy formation in an air flow directed through an HVAC system and for improving flow of air across a heat exchanger, such as a furnace, of the HVAC system. Specifically, embodiments are directed to baffles configured to be installed in the HVAC system with the heat exchanger. The baffles are configured to reduce eddy formation in an air flow and to reduce formation of hot spots in tubes of the heat exchanger. For example, each baffle may include a flange attached to a housing of the HVAC system, a first baffle portion extending from the portion into an air flow through the HVAC system and toward the heat exchanger, and a second baffle portion extending from the first baffle portion toward the housing. The second baffle portion may be disposed at an oblique angle relative to a direction of air flow through the housing. Accordingly, the second baffle portion may redirect the air flow toward tubes of the heat exchanger. By virtue of the baffle configuration (e.g., angled configuration), the air flow may retain laminar properties as the air flow is directed to more evenly flow across the tubes, and heat may transfer between the tubes to the air flow more efficiently. Further, the first baffle portion may block recirculation of the air flow and/or formation of eddies in the air flow, in the manner described above. In this way, the baffles disclosed herein enable improved heat transfer, more efficient air flow, reduced power consumption of the HVAC system, and more efficient operation of the HVAC system generally. The technical effects and technical problems in the specification are examples and are not limiting.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A baffle for a furnace of a heating, ventilation, and air conditioning (HVAC) system, comprising:

a mounting flange configured to be secured to a housing panel of a housing of the furnace;

a first panel extending from the mounting flange and away from the housing panel into an air flow path extending through the furnace; and a second panel extending from the first panel and converging toward the housing panel in an upstream direction, relative to a direction of air flow along the air flow path, wherein the first panel is a first planar member extending linearly from the mounting flange to the second panel, and wherein the second panel is a second planar member extending linearly from the first planar member.

2. The baffle of claim 1, wherein the first panel is configured to extend generally perpendicularly from the housing panel in an installed configuration of the baffle.

3. The baffle of claim 1, wherein the mounting flange is a first flange, and the baffle comprises a second flange extending from the second panel, wherein the second flange is configured to abut the housing in an installed configuration of the baffle.

4. The baffle of claim 3, wherein the second flange is configured to abut an insulation layer of the housing in the installed configuration of the baffle.

5. The baffle of claim 1, wherein the baffle is configured to be secured to the housing panel at a location aligned with a heat exchanger of the furnace along the direction of air flow along the air flow path.

6. The baffle of claim 1, wherein the first panel and the second panel are disposed at an angle between 40 and 50 degrees relative to one another.

7. The baffle of claim 1, wherein the mounting flange, the first panel, and the second panel are integrally formed as a single piece.

8. A furnace of a heating, ventilation, and air conditioning (HVAC) system, comprising:

a housing defining an air flow path therethrough; and a baffle mounted to a housing panel of the housing, comprising:

a flange secured to the housing panel;

a first panel extending from the flange and away from the housing panel into the air flow path; and a second panel extending from the first panel and converging toward the housing panel in an upstream direction, relative to a direction of air flow along the air flow path, wherein the first panel is a first planar member extending linearly from the flange to the second panel, and wherein the second panel is a second planar member extending linearly from the first planar member.

9. The furnace of claim 8, comprising a heat exchanger disposed within the housing and along the air flow path, wherein the baffle and the heat exchanger overlap one another along an axis of the air flow path through the housing.

10. The furnace of claim 9, wherein the heat exchanger comprises a plurality of tubes defining a first pass, a second pass, and a third pass of the heat exchanger, wherein the second panel overlaps the second pass, the third pass, or both along the axis of the air flow path through the housing.

11. The furnace of claim 8, wherein the second panel extends linearly and at an oblique angle relative to the housing panel.

12. The furnace of claim 11, wherein the first panel extends linearly and generally perpendicularly from the housing panel.

13. The furnace of claim 8, wherein the first panel and the second panel are disposed at an angle between 40 and 50 degrees relative to one another.

14. The furnace of claim 8, wherein the flange, the first panel, and the second panel are formed from a single piece of material.

15. A furnace, comprising:

a housing comprising a plurality of housing panels coupled to one another to define an air flow path extending through the housing;

a heat exchanger disposed within the air flow path of the housing; and a baffle secured to a housing panel of the plurality of housing panels, wherein the baffle comprises:

a flange mounted to the housing panel;

a first baffle panel extending from the flange and away from the housing panel into the air flow path, wherein the first baffle panel extends toward the heat exchanger; and a second baffle panel extending from the first baffle panel and converging toward the housing panel in an upstream direction, relative to a direction of air flow along the air flow path, wherein the first baffle panel is a first planar member extending linearly from the flange to the second baffle panel, and wherein the second baffle panel is a second planar member extending linearly from the first planar member.

16. The furnace of claim 15, wherein the housing panel is a first housing panel of the plurality of housing panels, the baffle is a first baffle, and the furnace comprises a second baffle secured to a second housing panel of the plurality of housing panels, wherein the first housing panel is disposed opposite the second housing panel relative to the air flow path of the housing.

17. The furnace of claim 16, wherein the flange is a first flange, and wherein the second baffle comprises:

a second flange mounted to the second housing panel;

a third baffle panel extending from the second flange into the air flow path and toward the heat exchanger; and a fourth baffle panel extending from the third baffle panel toward the second housing panel.

18. The furnace of claim 17, wherein the first baffle panel and the second baffle panel are disposed at a first angle between 40 and 50 degrees relative to one another, and wherein the third baffle panel and the fourth baffle panel are disposed at a second angle between 40 and 50 degrees relative to one another.

19. The furnace of claim 15, wherein the heat exchanger comprises a plurality of tubes defining a first pass, a second pass, and a third pass of the plurality of tubes, wherein the second baffle panel overlaps the second pass, the third pass, or both along an axis of the air flow path through the housing to direct an air flow toward the second pass, the third pass, or both.

20. The furnace of claim 15, wherein the flange, the first baffle panel, and the second baffle panel are integrally formed from a single piece of material.

* * * * *